United States Patent [19]

Jones

[11] Patent Number: 5,066,003

[45] Date of Patent: Nov. 19, 1991

[54] LEG CURL EXERCISE MACHINE

[75] Inventor: Gary A. Jones, Falmouth, Ky.

[73] Assignee: Hammer Corporation, Cincinnati, Ohio

[21] Appl. No.: 581,585

[22] Filed: Sep. 12, 1990

[51] Int. Cl.[5] ..... A63B 21/00

[52] U.S. Cl. ..... 272/134; 272/132; 272/144; 128/25 R

[58] Field of Search ..... 272/118, 117, 72, 73, 272/144, DIG. 4, 123, 134, 901, 136, 130

[56] References Cited

U.S. PATENT DOCUMENTS

| | | | |
|---|---|---|---|
| 3,858,873 | 1/1975 | Jones . | |
| 3,998,454 | 12/1976 | Jones | 272/117 |
| 4,720,099 | 1/1988 | Carlson | 272/134 |

OTHER PUBLICATIONS

Brochure, "Leverage Machines" by Nautilus®, Instruction Manual, p. 6.

*Primary Examiner*—Richard J. Apley
*Assistant Examiner*—Jerome W. Donnelly
*Attorney, Agent, or Firm*—Wood, Herron & Evans

[57] ABSTRACT

A leg curl exercise machine includes a frame, a platform supported by the frame along a vertical midplane and a pair of levers pivotally connected to the frame in front of the platform. The forward ends of the levers are adapted to hold removable weights and, during performance of a leg curl exercise, are adapted to be acted upon by the legs of an exerciser supported on the platform. The levers pivot along outer planes of movement that diverge from the front of the frame and tilt inwardly toward the top of the frame, thereby coupling the force applied by the legs against separate weight resistances that move through planes that naturally accommodate the musculoskeletal make-up of a person.

27 Claims, 4 Drawing Sheets

LEG CURL EXERCISE MACHINE

FIELD OF THE INVENTION

This invention relates to a leg curl exercise machine that accommodates the natural musculoskeletal makeup of a person.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines to maximize the effect of working out a desired number of muscle groups.

One exercise maneuver that is frequently performed on an exercise machine is referred to as a leg curl. The leg curl exercise is performed from a prone, face down position and involves the bending, against a pivotal weight resistance, of one leg or both legs from a straight, extended position to a flexed position. During the exercise, the applied force of the legs is directed against pads connected to a pivotal lever. At the end of the exercise, when the legs are flexed, the pads reside between the back of the hamstrings and the Achilles tendons of the exerciser. Removable weights, or a stationary stack of weights are connectable to the lever to provide a selectable weight resistance that is exercised against.

There are presently a number of different machines available for performing a leg curl exercise. Some leg curl machines simply utilize a lever pivotally connected to a frame that includes a horizontal support, with removable weights supported on the lever. While relatively simple in construction, these machines are rather awkward for the exerciser because the horizontal support does not provide good leverage for performing the leg curl motion. Moreover, the support must remain substantially flat because these particular machines are generally also used for performing a leg extension exercise from a seated, forward-facing position on the platform.

Other leg curl exercise machines utilize a pulley and cable to direct the exercise movement against the weight resistance. At least one leg curl machine uses an eccentric cam and chain mechanism for the same purpose. Leg curl machines which utilize a cable/chain linkage require periodic maintenance to prevent friction buildup which effectively results in an undesired increase in weight resistance that acts against the leg curl movement. Moreover, the additional parts required by cable/chain linkage machines are also susceptible to wearing out or functioning improperly, thus necessitating removal and repair.

Perhaps more importantly, these other leg curl machines do not always feel right or "fit" the body properly. For instance, structural components such as the pivot point or the lever length seem to be sized disproportionately for a large number of athletes. While some portion of this awkwardness may be attributable to the fact that most exercise machines are sized or shaped for an "average" size person and many people who use these machines are simply not of "average" musculoskeletal structure, there is also another degree of awkwardness which does not seem to be size-related at all. This latter degree of awkwardness relates to unnatural musculoskeletal positioning that results directly from the orientation of the machine itself, even for an average size individual. As a result, muscles, bones and/or joints are subjected to unnecessary shear or compression stress during the performance of exercise with these machines. Moreover, the maximum muscular benefit is not achieved.

These disadvantages are particularly unfortunate in the case of both the leg curl exercise and the leg extension exercise because these complementary exercises work opposing muscle groups that are considered critical to minimizing the risk of injury to the knee joint, one of the body's most susceptible joints.

Finally, if the knee is injured, it is considered important to perform the leg curl and the leg extension exercises with one leg only during rehabilitation, to allow close monitoring of progress. Unfortunately, single leg performance of a leg curl exercise on most prior machines seems to accentuate the awkwardness or uncomfortable fit of the machine.

It is therefore an object of the invention to provide a leg curl exercise machine that maximizes the exercise benefit attainable during a leg curl maneuver while minimizing skeletal or joint stress associated therewith.

It is another object of the invention to provide a leg curl exercise machine that reduces or eliminates the unnatural feel that seems to be inherent with other leg curl exercise machines.

It is still another object of the invention to provide a leg curl exercise machine which is particularly suitable for exercising one leg at a time.

SUMMARY OF THE INVENTION

This invention contemplates a leg curl exercise machine that includes a frame, a platform secured to the frame along a vertical midplane and two weight supporting levers that are pivotally connected to the frame in front of the platform. During the performance of a leg curl, the forward ends of the levers are adapted to be pivoted upwardly with respect to the frame by the legs of an exerciser laying face down on the platform. Pivotal movement against the resistance of the supported weights occurs in non-parallel planes that diverge outwardly from the front of the machine and tilt inwardly toward the top of the machine.

Compared to prior leg curl machines, this leg curl machine better accommodates the natural musculoskeletal makeup of the human body. More particularly, the natural musculoskeletal makeup of the body is accommodated by the structural orientation of the levers, the platform, the initial starting angles of the levers and the locations of the pads which the legs bear against to move the levers. The particular combination of all of these structural aspects results in a machine which, based upon feedback from a number of individuals involved in the field of strength training, more naturally couples the muscular exertions of the leg curl against a preselected weight resistance and in a direction of motion that is compatible with the musculoskeletal structural makeup of the body.

Because it has two independently pivotal levers, this leg curl machine enables the performance of either simultaneous or alternate exercise of both legs. This feature is particularly important in monitoring rehabilitation progress after an injury, especially a knee injury, where it is often necessary to compare the relative strengths of the legs.

In a related aspect of this feature, the initial angle of the forward end of the lever and the counterweight at the rearward end of the levers substantially counterbalance the weights supported at the lower forward ends of the respective levers. As a result, for each lever, the initial moment arm about the pivot axis is close to zero, and the minimum weight that must be exercised against, i.e., with no weight plates supported, is very low. Therefore, and also because the pivotal lever has substantially no friction, the weights supported on the lever closely approximate the actual weight resistance that is exercised against. This feature becomes important during the initial stages of rehabilitation, when it may be required to exercise against very low weight resistance and keep highly accurate records of actual weight lifted.

This feature also represents an advantage over other leg curl machines which utilize either a pulley or a chain linkage. For these machines, the minimum weight resistance is often greater than the desired amount of initial resistance.

In accordance with a preferred embodiment of the invention, a leg curl exercise machine includes a frame, a platform secured to the frame along a vertical midplane and two levers pivotally connected to the frame near the front of the platform. The platform includes a forwardly declining section and a rearwardly declining section. Lower, forward ends of the levers include support arms with outer ends for holding weighted plates. The support arms extend inwardly toward the midplane, and connectors extend forwardly and upwardly from the inner ends of the support arms. Pads rotatably mounted to the forward ends of the connectors are adapted to be engaged and moved upwardly by the backs of the legs of an exerciser lying face down on the platform, during performance of a leg curl. The distance of the pads from the support arms, the angles between the connectors and the levers, and the declining angles of the two sections of the platform place the exerciser in a natural position for coupling an applied, upward leg curl force to two outer, non-parallel planes of lever motion. The levers pivot along outer planes that diverge from the front of the frame, and tilt inwardly toward a top of the frame.

Compared to prior leg curl machines, these outer planes more naturally accommodate the structure of the human body relative to the leg curling motion utilized in a leg curl exercise. As a result, a person lying on the platform is able to maximize the muscular benefits attainable by performing a leg curl exercise, while minimizing joint stress. Use of this invention provides exercise for a muscle group that includes the hamstrings, the calves and the muscle and tissue that surrounds and supports the knee joint.

The structural orientation of this leg curl exercise machine evolved from applicant's belief that most exercise machines, including leg curl exercise machines, oversimplify the musculoskeletal movements of the human body. While his accumulated years of observing and analyzing athletic movements of the body led him to conclude that most musculoskeletal movements are rather complex and involve multiple joints and multiple degrees of freedom, he also recognized that most exercise machines require bodily movement in directions or planes that are oriented simply at right angles or parallel to the torso of the body. Based on these observations, and bolstered by his opinion that the ultimate objective of any exercise machine is to provide maximum muscular benefit with minimum joint stress, applicant perceived a need for improvement in the design of exercise machines and began working toward that goal. Feedback from athletes who have used this inventive leg curl exercise machine has confirmed that it constitutes an improvement over pre-existing leg curl exercise machines.

With this machine, the moment arm created by the lever about the pivot point is lowest upon initiation of the extension motion and it increases gradually throughout the motion until the lever is parallel with the ground. The moment arm about the pivot point begins decreasing again from the maximum value as the lever is rotated above the horizontal position.

According to another feature of the invention, a removable pin is provided for each lever to limit the range of the exercise motion by limiting downward pivotal motion of the lever. This pin changes the initial, at rest angle of the lever with respect to vertical.

These and other features of the invention will be more readily understood in view of the following detailed description and the drawings.

DETAILED DESCRIPTION OF THE DRAWINGS

Figure 1:
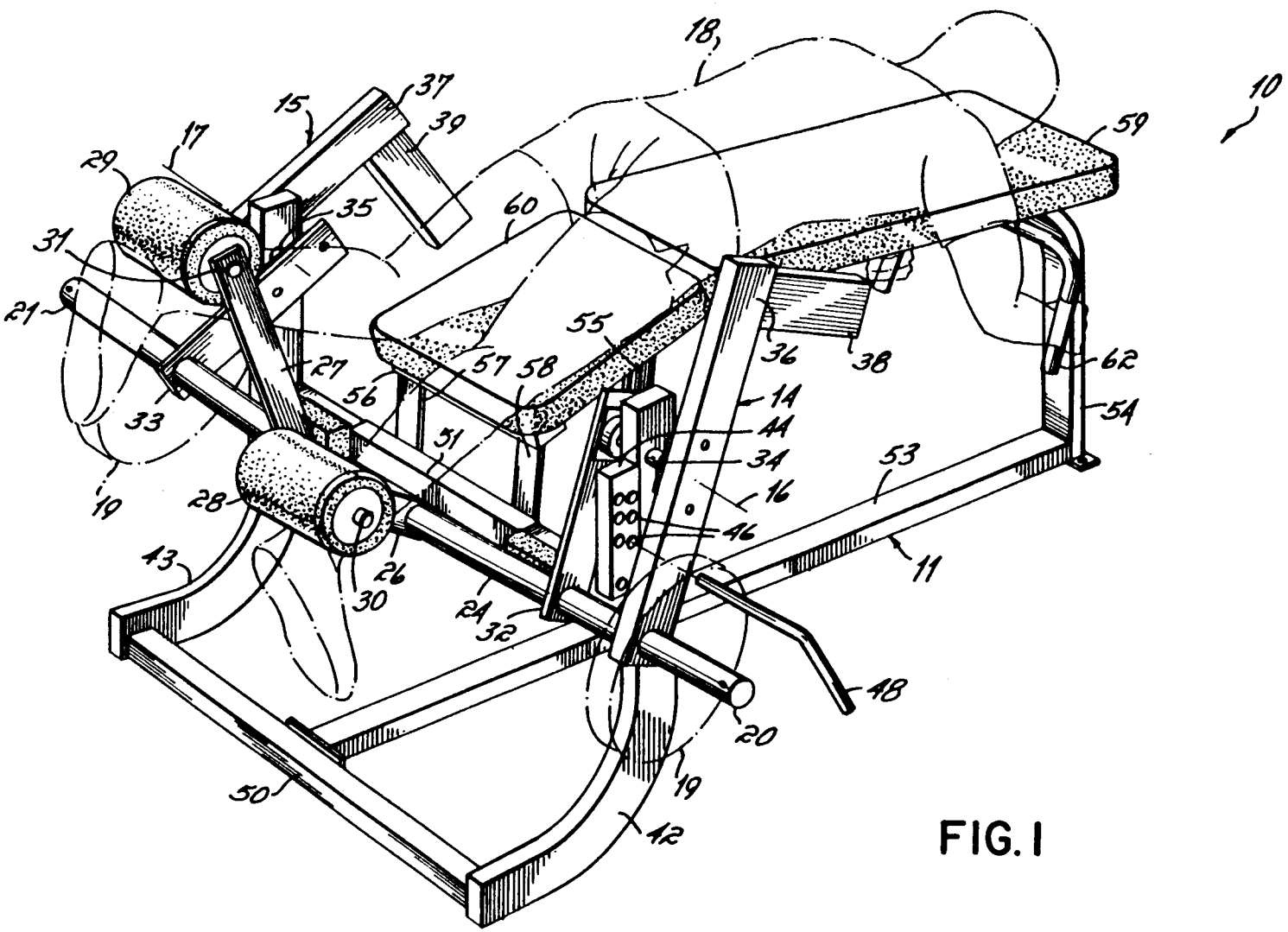
FIG. 1 is a perspective view showing a leg curl exercise machine in accordance with a preferred embodiment of the invention, with an exerciser on the machine performing a leg curl exercise with one leg.

FIGS. 1–4 show a leg curl exercise machine 10 in accordance with a preferred embodiment of the invention. This machine 10 includes a frame 11 made of a number of straight and curved sections of heavy duty steel that are either welded or bolted together, or pivotally connected. Exercise levers 14 and 15 are pivotally connected to the frame 11 for pivotal movement about axes 16 and 17, respectively. During the performance of a leg curl exercise, an exerciser 18 curls the legs to pivot the levers 14 and 15 upwardly against one or more weights 19 supported on hubs 20 and 21, respectively. Hubs 20 and 21 are actually the outer or exterior ends of support arms 24 and 25, respectively. Connectors 26 and 27 extend upwardly and outwardly from the inner ends of support arms 24 and 25, respectively. Connectors 26 and 27 support pads 28 and 29, respectively, against which the backs of the legs of an exerciser 18 exert a force during the performance of a leg curl maneuver. Preferably, pads 28 and 29 are circular in cross-section, and rotatable upon hubs 30 and 31, respectively.

Interior supports 32 and 33 are connected to levers 14 and 15, respectively, for additional stability. The upper ends of supports 32 and 33 connect to axles 34 and 35, respectively, which extend along pivot axes 16 and 17, respectively. Rearward, upper ends 36 and 37 of the levers 14 and 15 have counterweights 38 and 39, respectively, which extend rearwardly therefrom. These counterweights substantially balance the weight of levers so that, when there are no weights supported on the hubs 20, 21, the levers 14, 15 have virtually no weight resistance.

Levers 14 and 15 are supported by uprights 42 and 43, respectively. Blocks 44 and 45 are secured to the front of uprights 42 and 43, respectively, each of the blocks having a plurality of holes adapted to receive a removable pin 48 (FIG. 1) in order to vary the initial, at rest, position of the levers within their respective planes of movement. For this purpose, block 44 has holes 46 formed laterally therein. Similarly, block 45 also has holes (not shown) formed laterally therein. The pin 48 is sized to be received within one of the holes 46 in block 44, while another pin (not shown) is used for the holes in block 45. If the pins for both levers are not used, the levers simply rest against the frame.

Figure 3:
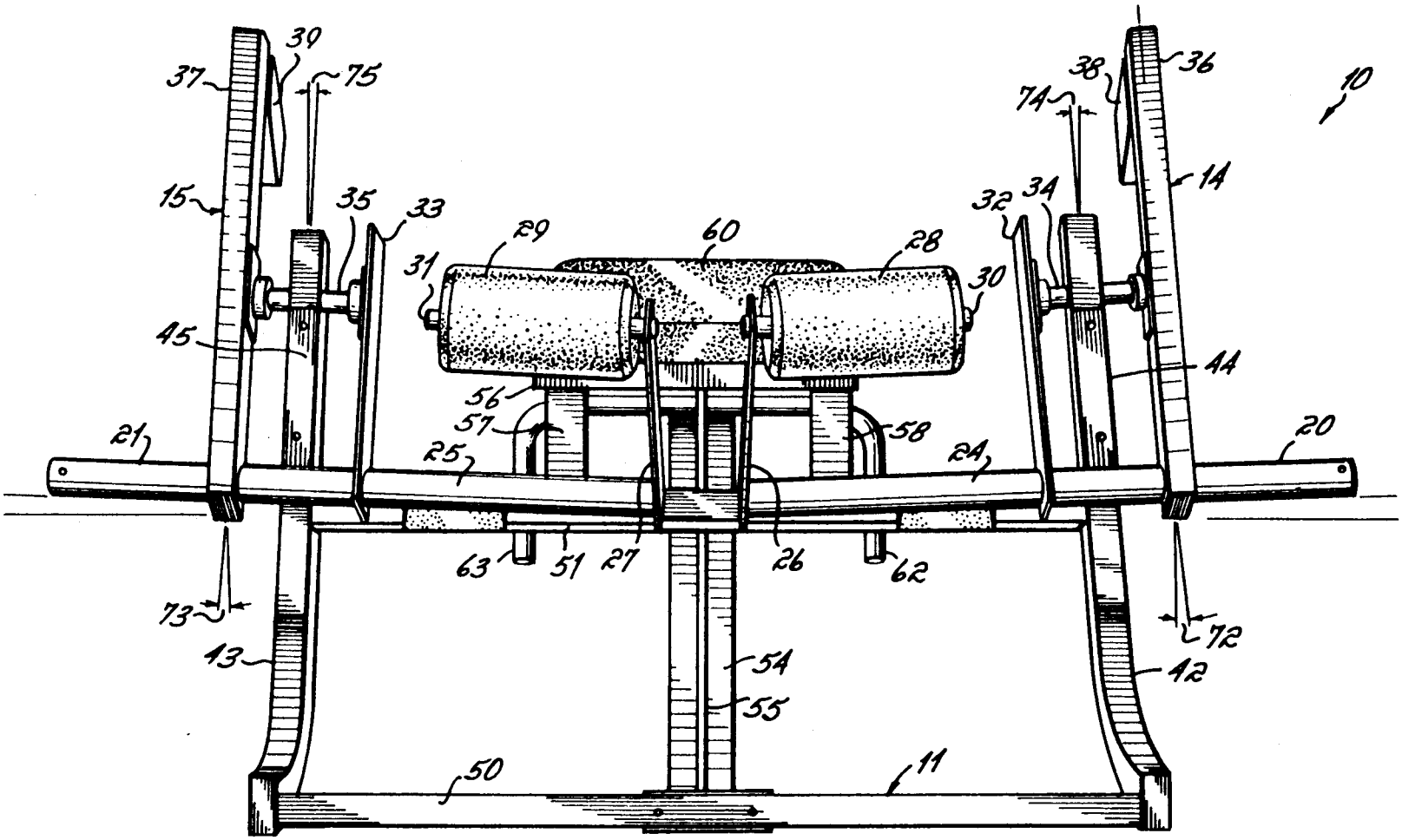
FIG. 3 is a front view of the leg exercise machine shown in FIG. 2.
Figure 4:
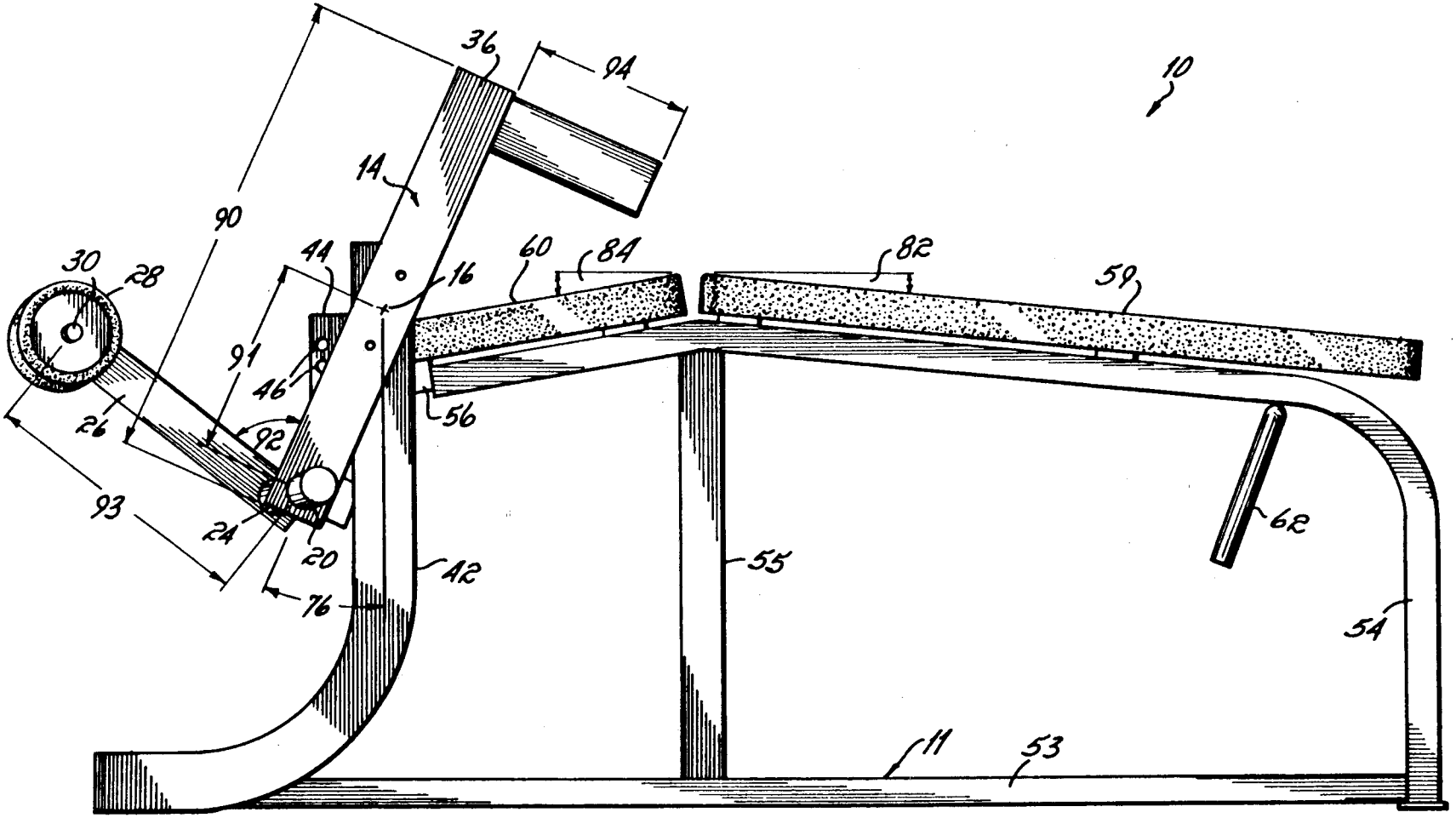
FIG. 4 is a side view of the leg exercise machine shown in FIG. 2.

The uprights 42 and 43 bend forwardly, and their front ends are connected by a bottom lateral brace 50. Just below blocks 44 and 45, uprights 42 and 43, respectively, are connected by an intermediately located lateral brace 51. This brace 51 is shown in FIGS. 1 and 3. Bottom brace 50 is connected to a center longitudinal brace 53 that extends rearwardly along the center of the frame 11. Rear upright 54 is connected to a rearward end of center brace 53. The rear upright 54 extends vertically upward, and then bends forwardly, and is supported by a center leg 55 (FIG. 4). Forwardly of leg 55, upright 54 connects to a cross bar 56 which has an outer end to which downwardly extending support members 57 and 58 are connected. The bottom ends of these support members are secured to the intermediate lateral brace 51.

Platforms 59 and 60 are secured to the forwardly extending portion of upright 54. The platforms 59 and 60 support a person 18 on the frame 11 during performance of the leg curl exercise. With the exerciser 18 laying face down upon platforms 59 and 60 (FIG. 1), the knees located just slightly outboard of the forward edge of platform 60, and with the backs of the legs located beneath the rotatable pads 28 and 29, force directed against the pads 29 and 30 during the leg curl rotates the levers forwardly and upwardly. Because two independently pivotal levers are provided, both legs may be exercised, either simultaneously or alternately.

Figure 2:
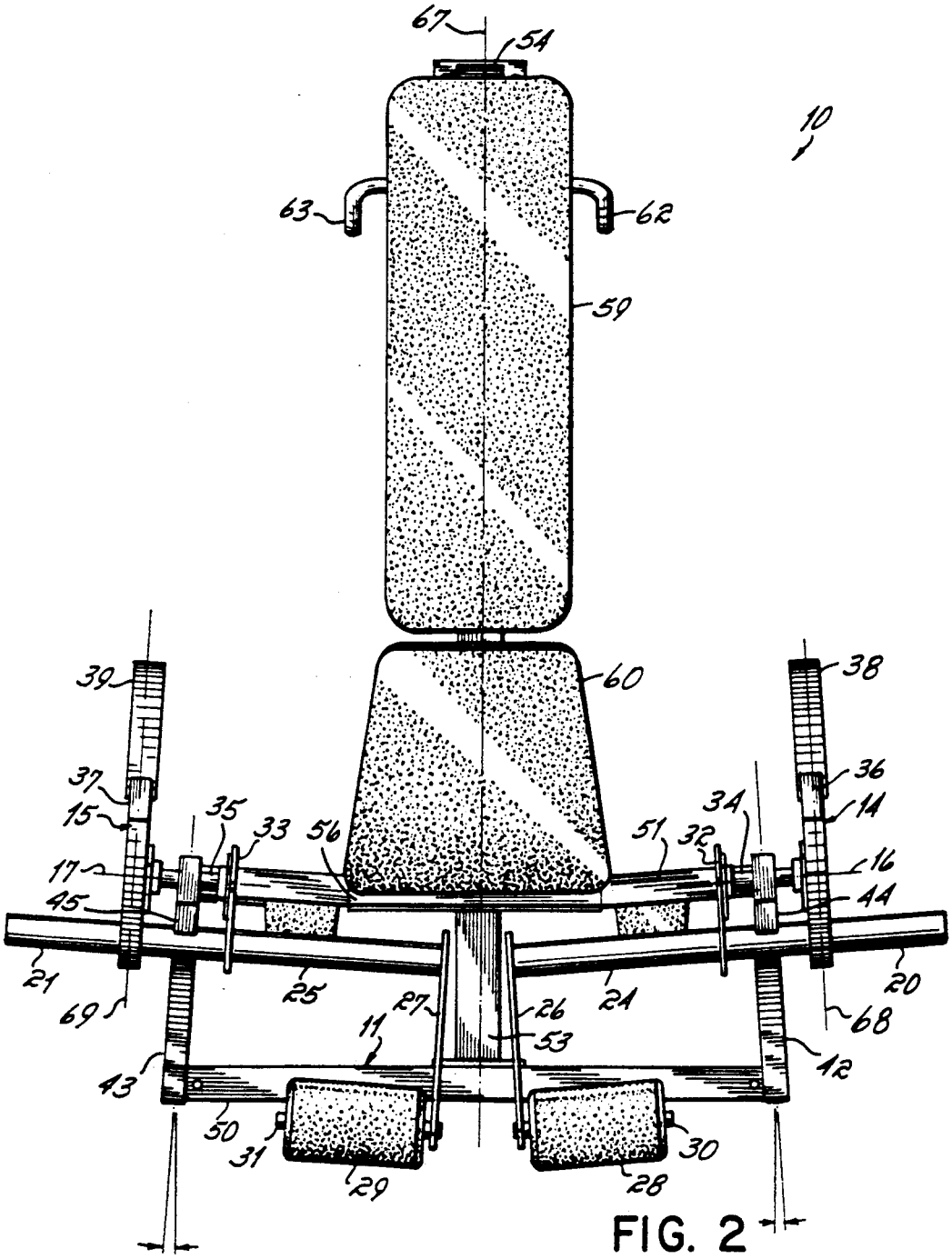
FIG. 2 is a top view of the leg exercise machine shown in FIG. 1, without the exerciser and with the levers located in an at rest position.

FIG. 2 shows a vertical midplane 67 that bisects the frame 11. The machine 10 is symmetric with respect to the central vertical midplane 67. FIG. 2 also shows that levers 14 and 15 pivot along planes of movement that are non-parallel with respect to plane 67. More particularly, lever 14 moves along a plane 68 that diverges outwardly from the front, or forwardly facing direction, of the frame 11. Preferably, this angle of divergence is about 4°. Similarly, lever 15 moves along an opposite plane that also diverges outwardly with respect to the front of the frame. This outer, outwardly diverging plane is designated by numeral 69, and the angle of divergence is also preferably about 4°.

FIG. 3 also shows that non-parallel planes 68 and 69 are tilted slightly inwardly toward the top of the frame 11. The inward angle of tilt for each of these planes is preferably about 2°, angles designated by the numerals 72 and 73, respectively. As shown in FIG. 2, forward, bottom ends of uprights 42 and 43 diverge outwardly at angles of about 4°, designated by numerals 74 and 75, respectively. The divergence at the bottom ends is achieved by making brace 50 longer than brace 51 and then welding the uprights at the desired angles. To provide the tilt, uprights 42 and 43 are preferably bent in a jig, prior to connection to the frame 11. This bending twists the upper ends of uprights 42 and 43 inwardly to accommodate the desired angles of tilt for planes 68 and 69, respectively. As shown in FIG. 3, the axes of pivotal movement 16 and 17 are perpendicular to planes 68 and 69, respectively. Levers 14 and 15 pivot via bearings connected to the outer ends of the axles 34 and 35, respectively. The axles 34 and 35 are preferably rigidly connected to the uprights 42 and 43.

As shown in FIG. 4, platform 59 declines rearwardly at a preferable angle of about 5°, designated by numeral 82. Platform 60 declines forwardly at a preferable angle of about 10°, designated by numeral 84. Therefore the angle between declined platforms 59 and 60 is preferably about 115°.

Numeral 90 designates the overall length of lever 14, which is preferably about 24.5". Numeral 91 designates the distance between the support arm and pivot axis 16, a distance which is preferably about 10.0". The angle between lever 14 and connector 26 is designated by numeral 92, an angle preferably of about 77°. The length of the connector 26 is designated by numeral 93 and is preferably about 11.0". The counterweight 38 is preferably in the form of a square shaped member that extends rearwardly from the top of lever 14. As shown in FIG. 4, the rearward extension of counterweight 38 is designated by numeral 94, and is preferably a distance of about 11.5". The initial, at rest angle of the levers is designated by numeral 76, and is preferably about 25° from vertical. This angle may be increased to about 65° by using pin 48. It is to be understood that this angle is measured within its respective outer plane.

The planes of movement of the levers 14 and 15, with respect to the frame 11, the initial, at rest angles of the levers, the location of the pads 28 and 29 with respect to the pivot axes 16 and 17, and the forwardly and rearwardly declining sections of the platform all combine to enable the motive force of the leg curl motion to be applied in two outer planes which, compared to prior leg curl machines, more naturally accommodate the musculoskeletal structure of a human being.

As mentioned previously, frame 11 enables a person to perform a leg curl exercise either simultaneously with both legs or independently with one leg at a time, which provides a significant advantage over prior leg curl machines. Moreover, because the counterweights enable a very low weight to be exercised against, this leg curl machine is particularly advantageous for rehabilitation.

While a preferred embodiment of the invention has been described, it is to be understood that the invention is not limited thereby and that in light of the present disclosure, various other alternative embodiments will be apparent to a person skilled in the art. For instance, the exact structural orientation of some of the parts or portions of the frame 11 is not critical, so long as the positioning of the support and pivot axes with respect to two outer planes of motion is maintained. Additionally, while the particular angles of the outer planes of movement shown in the Figs. are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A leg curl exercise machine comprising:
a frame;
a platform secured to the frame along a vertical midplane;
a lever pivotally connected to the frame in front of the platform, the lever adapted to hold at least one removable weight at a forward, lower end thereof and adapted to be pivoted upwardly by the back of the leg of an exerciser supported on the platform during the performance of a leg curl, the lever being pivotal in a plane that is non-parallel with respect to the central vertical plane.

2. The leg curl exercise machine of claim 1 wherein the non-parallel plane of pivotal lever movement diverges from the front of the frame.

3. The leg curl exercise machine of claim 2 wherein the angle of divergence is about 4°.

4. The leg curl exercise machine of claim 1 wherein the non-parallel plane of pivotal movement tilts inwardly towards a top portion of the frame.

5. The leg curl exercise machine of claim 4 wherein the plane of pivotal movement tilts inwardly at an angle of about 2°.

6. The leg curl exercise machine of claim 1 wherein the non-parallel plane of movement diverges from the front of the frame and tilts inwardly toward the top of the frame.

7. The leg curl exercise machine of claim 1 and further comprising:
a counterweight connected to a rearward end of the lever.

8. The leg curl exercise machine of claim 1 and further comprising:
a support rod having an outer end for holding removable weights, an opposite end of the support rod extending inwardly toward the vertical midplane;
a connector attached to an inner end of the support rod and extending forwardly and upwardly therefrom; and
a hub and pad assembly connected to an upper end of the connector, the hub adapted to be acted upon by the back of the leg of an exerciser supported on the platform during the performance of a leg curl.

9. The leg curl exercise machine of claim 1 wherein the pivotal lever has an initial, at rest, position at an angle of about 25° from vertical.

10. The leg curl exercise machine of claim 1 and further comprising:
means for selectively varying an initial, at rest, angle of the pivot lever.

11. The leg curl exercise machine of claim 1 wherein the platform includes two sections.

12. The leg curl exercise machine of claim 11 wherein a forward section of the platform declines forwardly and a rearward section of the platform declines rearwardly.

13. The leg curl exercise machine of claim 12 wherein the forwardly and rearwardly declinging angles are about 10° and 5°, respectively.

14. A leg curl exercise machine comprising:
a frame;
a platform secured to the frame along a vertical midplane;
a pair of levers pivotally connected to the frame in front of the platform, each lever having a forward end adapted to hold at least one removable weight and adapted to be pivoted upwardly by one leg of an exerciser supported on the platform during the performance of a leg curl, the levers being pivotal in outer planes that are non-parallel with respect to the vertical midplane.

15. The leg curl exercise machine of claim 14 wherein each of the outer planes diverges from the front of the frame.

16. The leg curl exercise machine of claim 15 wherein each of the outer planes diverges at an angle of about 4°.

17. The leg curl exercise machine of claim 14 wherein each of the outer planes tilt inwardly toward the top of the frame.

18. The leg curl exercise machine of claim 17 wherein each of the outer planes tilt inwardly at an angle of about 2°.

19. The leg curl exercise machine of claim 14 and further comprising:
a pair of support rods, each support rod connected to one of the levers and oriented perpendicular to the outer plane of pivotal movement of the respective lever, each support rod having an outer end adapted to hold one or more removable weights;
a pair of connectors, each connector secured to an inner end of a support rod and extending forwardly and upwardly therefrom; and
a pair of pads, each pad connected to a forward end of a connector, the pads adapted to be acted upon by an exerciser supported on the platform during performance of a leg curl.

20. The leg curl exercise machine of claim 19 wherein each connector is angularly displaced from its respective lever by an angle of less than 90°.

21. The leg curl exercise machine of claim 20 wherein each connector is angularly displaced at an angle of about 77°.

22. The leg curl exercise machine of claim 14 and further comprising:
a pair of counterweights, each counterweight connected to an upper rearward end of a lever and adapted to substantially counterbalance a forward end of the lever when no removable weights are held thereon.

23. The leg curl exercise machine of claim 14 wherein each lever has an initial, at rest, position of about 25° from vertical with its respective outer plane.

24. The leg curl exercise machine of claim 14 and further comprising:
means for selectively varying an initial, at rest, angle of each of the levers within its respective outer plane.

25. A leg curl exercise machine comprising:
a frame;
a platform supported by the frame along a vertical midplane; and
a pair of pivotal levers, each lever having a forward end adapted to hold at least one removable weight and adapted to be acted upon by the leg of an exerciser supported on the platform during the performance of a leg curl, each lever adapted to pivot in an outer plane of movement that diverges from a forward end of the machine.

26. The leg curl exercise machine of claim 25 wherein the outer planes tilt inwardly toward a top of the frame.

27. The leg curl exercise machine of claim 25 wherein the platform includes a forwardly declining section and a rearwardly declining section.

* * * * *